United States Patent [19]

Mitchell, Jr.

[11] 4,145,679

[45] Mar. 20, 1979

[54] VAPORIZATION COOLED AND INSULATED ELECTRICAL INDUCTIVE APPARATUS

[75] Inventor: George F. Mitchell, Jr., Hickory Township, Mercer County, Pa.

[73] Assignee: Electric Power Research Institute, Inc., Palo Alto, Calif.

[21] Appl. No.: 904,159

[22] Filed: May 9, 1978

Related U.S. Application Data

[63] Continuation of Ser. No. 771,142, Feb. 23, 1977, abandoned.

[51] Int. Cl.[2] ..... H01F 27/10

[52] U.S. Cl. ..... 336/57; 174/12 R; 336/58; 336/60

[58] Field of Search ..... 336/90, 92, 94, 55, 336/57, 58, 59, 60, 61; 174/12 R, 12 BH, 16 R, 15 R, 17 CF

[56] References Cited

U.S. PATENT DOCUMENTS

| | | | |
|---|---|---|---|
| 1,688,737 | 10/1928 | Moody | 174/12 R |
| 1,732,719 | 10/1929 | Hill | 336/58 |
| 1,883,830 | 10/1932 | Palley | 336/58 X |
| 2,774,807 | 12/1956 | Whitman | 336/58 X |
| 2,777,009 | 1/1957 | Whitman | 336/94 X |
| 2,872,651 | 2/1959 | Treanor | 174/15 R |
| 2,961,476 | 11/1960 | Maslin et al. | 174/12 R |
| 3,201,728 | 8/1965 | McWhinton | 336/94 X |
| 3,271,711 | 9/1966 | Berg | 336/57 |
| 3,668,583 | 6/1972 | Nichols | 336/60 X |
| 3,670,276 | 6/1972 | Theodore | 336/94 X |

*Primary Examiner*—Thomas J. Kozma
*Attorney, Agent, or Firm*—D. R. Lackey

[57] ABSTRACT

Electrical inductive apparatus cooled and electrically insulated by a vaporizable liquid dielectric having a boiling point within the normal operating temperature range of the apparatus. When the electrical inductive apparatus is at ambient temperature, the liquid dielectric completely fills the enclosure providing electrical insulation for the electrical members. As the temperature of the apparatus increases towards its normal operating range, the liquid dielectric is gradually withdrawn into a reservoir until, at the normal operating temperature, only a quantity of liquid dielectric sufficient to completely cover the electrical inductive apparatus remains in the enclosure. In response to a temperature decrease, the liquid stored in the reservoir is gradually returned to the enclosure thereby maintaining a constant level of dielectric strength between the electrical members.

6 Claims, 2 Drawing Figures

VAPORIZATION COOLED AND INSULATED ELECTRICAL INDUCTIVE APPARATUS

This is a continuation of application Ser. No. 771,142 filed Feb. 23, 1977 now abandoned.

BACKGROUND OF THE INVENTION

1. Field of the Invention

This invention relates to electrical inductive apparatus and, more specifically, to electrical inductive apparatus wherein cooling and electrical insulation is achieved by vaporization of a liquid dielectric applied to the heat producing members.

2. Description of the Prior Art

It is well known in the electrical industry to completely immerse electrical apparatus, such as transformers, reactors, and the like, in a liquid dielectric for the joint purpose of cooling the heat producing elements and electrically insulating the elements from each other. However, certain disadvantages, such as the large quantities of liquid used, and the high cost of such liquids due to inflammability requirements, have attended the use of this type of cooling system.

As an alternative to the cooling and insulating of electrical apparatus by circulating liquids such as oil or askarel, the cooling may be affected by the vaporization of an inert liquid which is applied to the heat producing elements. This liquid, which has a boiling point within the normal operating temperature range of the electrical inductive apparatus, evaporates as it contacts the heat producing elements and removes heat from the electrical apparatus in quantities equal to the latent heat of vaporization of liquid. The resulting vapors are then condensed and reapplied to the heat producing elements in a continuous cycle. Not only does the vaporization of such a liquid remove heat more efficiently than oil circulation cooling systems, it also provides the necessary insulation between electrical elements in its vapor phase at the normal operating temperature and pressure of the electrical inductive apparatus. However, the insulating properties of the vapor are directly proportional to the pressure existing within the enclosure surrounding the electrical inductive apparatus. In systems utilizing liquid coolants in such small quantities that only a small portion of the electrical apparatus is immersed in the liquid coolant, the vapor pressure of the liquid coolant at ambient pressures is low and the amount of vapor within the enclosure surrounding the electrical apparatus is insufficient to provide adequate insulation when the electrical apparatus is initially energized or is operating at very light loads.

In order to provide adequate insulation for initial startup, it is known to use a second fluid in combination with the vaporizable liquid, wherein the second fluid provides the necessary electrical insulation for initial energization of electrical apparatus. Thus, U.S. Pat. No. 2,875,263 in the name of P. Narbut utilizes a noncondensable gas, such as sulfur hexafluoride; while U.S. Pat. No. 3,243,495, in the name of V. Mazza, employs a second vaporizable liquid which has a lower boiling point than the primary vaporizable liquid coolant. In both cases, the second fluid provides the necessary insulation between the electrical elements since, at normal atmospheric temperature and pressures, it occupies a major portion of a volume of the enclosure. However, in both systems, the temperature of the electrical apparatus will rise directly with the applied load and the composition of the atmosphere within the electrical apparatus will thereby contain greater proportions of the vapors of the primary vaporizable liquid. To prevent excessive pressure buildup within the enclosure and also to maintain cooling efficiency, the second fluid must be separated from the primary vaporizable liquid and removed from the main enclosure. Thus, these types of cooling systems include means for segregating the second fluid from the primary vaporizable liquid in response to an increase in pressure and temperature within the enclosure. Components used to separate the fluids not only affect the long-term reliability of the electrical apparatus but further, allow small amounts of the second fluid to be recirculated and thereby reapplied to the electrical apparatus. This reduces the overall effectiveness of the cooling system since these second fluids are ineffective as heat transfer mediums while in their gaseous state; and, therefore, necessitates the use of a larger cooling system to remove a given quantity of heat from the electrical apparatus.

It is also known to completely immerse the electrical apparatus in a vaporizable liquid dielectric. This type of cooling system provides excellent startup insulation as the liquid phase of these fluids is known to have better electrical insulating properties than the gaseous phase. Thus, U.S. Pat. No. 2,872,651, in the name of E. Treanor, shows a core and coil assembly completely immersed in a vaporizable liquid and contained in a sealed container within the main tank. An inert gas fills the remainder of the tank and also a portion of the sealed transformer cooling system. Although, satisfactory in operation, such an arrangement requires special sealing methods to insure that the inert gas is completely separated from the vaporizable liquid around the transformer so as to prevent any loss in cooling efficiency. Furthermore, the presence of even small quantities of the inert gas in the cooling system causes a loss in cooling effectiveness which creates higher temperatures in the electrical apparatus.

Therefore, it is still desirable to provide an evaporative cooling system for electrical inductive apparatus that exhibits maximum cooling efficiency with minimal liquid coolant usage, provides sufficient electrical insulative strength for initial startup of the electrical apparatus and lastly, has a high degree of reliability due to a simplified construction and minimal usage of moving components.

SUMMARY OF THE INVENTION

Herein disclosed is a new and improved electrical inductive apparatus wherein cooling and electrical insulating is effected by a vaporizable liquid dielectric. An electrical inductive apparatus, such as a transformer, is disposed in a form fit enclosure and is completely surrounded by solid insulation thereby defining a sump below the transformer and an open space in the upper portion of the enclosure wherein the bushings and electric leads are disposed. Additional solid insulation is disposed between the turns of the conductor to form cooling ducts which extend between the sump and the upper space of the enclosure. A liquid dielectric, which has a boiling point within the normal operating temperature range of the electrical inductive apparatus, completely fills the sump, cooling ducts and upper space of the enclosure when the transformer is under no load and at ambient temperatures and pressure; thereby providing adequate electrical insulation between the windings, bushings and leads to withstand the voltage surges associated with initial startup. As load is applied to the transformer and its temperature accordingly rises, a portion of the liquid dielectric contained in the cooling ducts of the transformer will evaporate and remove a quantity of heat from the heat producing members equal to the latent heat of vaporization of the liquid. The evolved vapors rise in the cooling ducts to the top of the enclosure and flow into a radiator wherein they subsequently condense and are returned by gravity to the sump at the bottom of the enclosure to resupply the liquid dielectric within the main enclosure. However, the rising temperature of electrical inductive apparatus, increases the percentage of the vapors of the liquid coolant contained within the casing which, in turn, causes pressure buildup within the case. In response to such a pressure rise, the portion of the liquid coolant contained in the space between the top of the case and the top of the electrical inductive apparatus will gradually be withdrawn into a reservoir until a level of liquid remains in the enclosure sufficient to cover the top of the electrical inductive apparatus; thereby providing aequate electrical insulation and cooling for the windings under normal operating conditions. The vapors of the liquid dielectric under the pressures existing in the case at the normal operating loads of the transformer are sufficient to provide adequate insulation for the leads and bushings in the top portion of the case. When the load is disconnected, the electrical inductive apparatus will gradually cool down thereby reducing the vapor pressure within the casing. The liquid dielectric contained in the reservoir will then flow by gravity back into the casing to maintain a constant level of dielectric strength between the bushings and electric leads.

By completely filling the case surrounding the electrical inductive apparatus with only one type of dielectric fluid and gradually withdrawing a portion of this fluid as the electrical inductive apparatus reaches its normal operating temperature and pressure, the usage of a second fluid for cold start insulation purposes, is eliminated. Furthermore, the deleterious effects on cooling efficiency which attend the usage of such a second fluid are avoided thereby allowing the use of a smaller, more efficient cooling system which removes the same quantity of heat as the larger cooling systems employed in the prior art. In addition, the use of a cooling and reservoir system which employs no moving parts to remove and return the excess liquid dielectric, greatly improves the reliability of the electrical inductive apparatus over prior art systems using two dielectric fluids since the prior art systems require complex pressure responsive devices and separation units to maintain adequate insulation and cooling over the wide range of operating conditions of the electrical inductive apparatus.

DESCRIPTION OF THE PREFERRED EMBODIMENT

Figure 1:
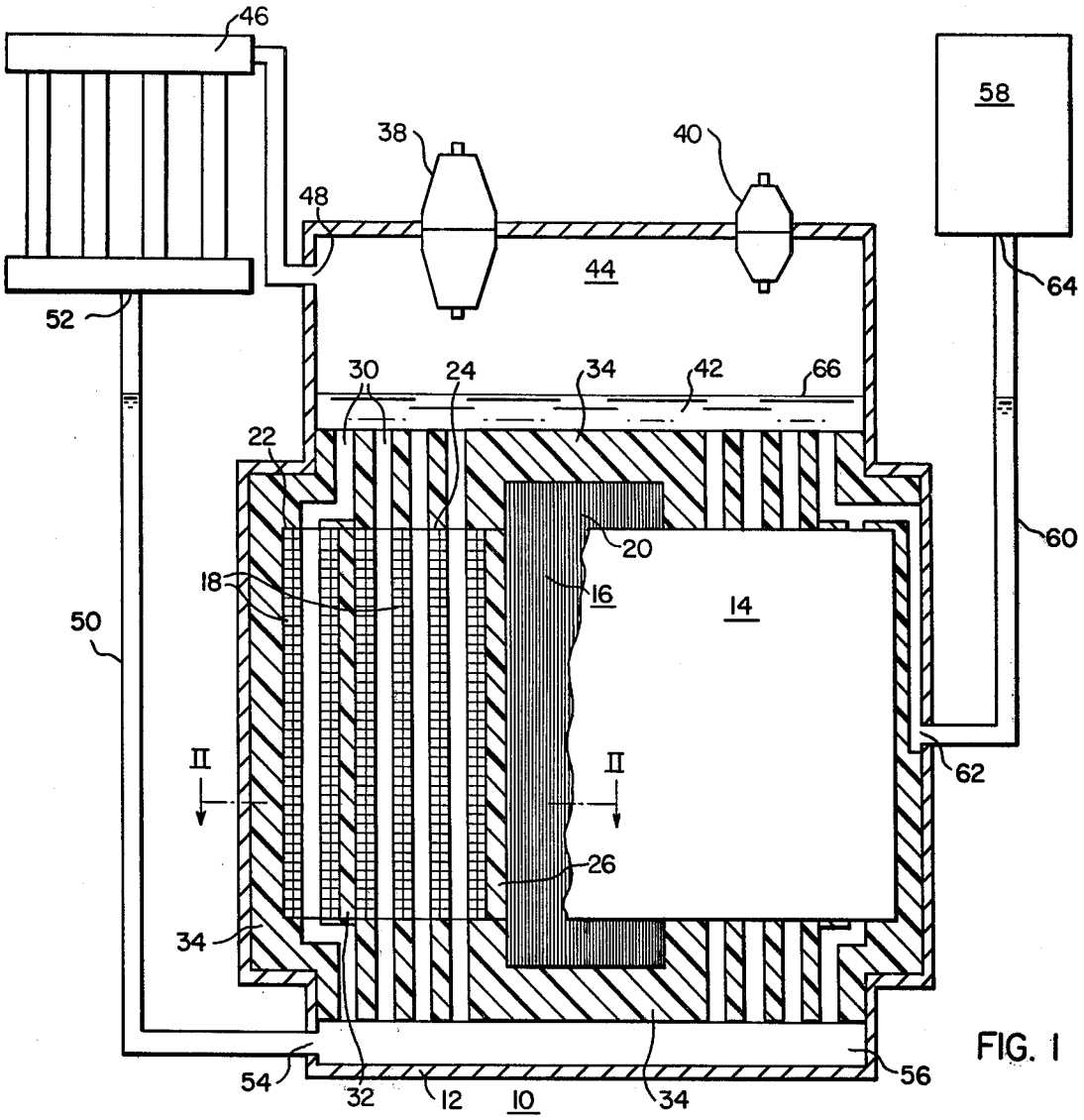
FIG. 1 is a side view, partly in section, and partly broken away of an electrical inductive apparatus constructed according to the teachings of this invention; and, FIG. 2 is a partial view along line II—II of FIG. 1.

Referring now to the drawing, and to FIG. 1 in particular, there is shown an electrical inductive apparatus 10 constructed according to the teachings of this invention. The electrical inductive apparatus 10 comprises a sealed enclosure or case 12 surrounding a heat producing member 14, such as a transformer, reactor or the like and, hereafter, referred to as a transformer which is subject to temperature changes while energized. The transformer 14 consists of a magnetic core and coil assembly 16 wherein phase windings are disposed in inductive relation with a magnetic core 20. For clarity purposes, only one vertical leg of the core 20 and one phase winding 18 of the transformer 14 are shown. The phase winding 18 consists of a high voltage conductor 22 and a low voltage conductor 24, each of which forms a plurality of turns around the core 20. In the preferred embodiment, the high voltage conductor 22 is wrapped around the low voltage conductor 24; although any other configuration of high and low voltage conductors along with any form of conductor, such as strap or sheet, may be utilized.

Figure 2:
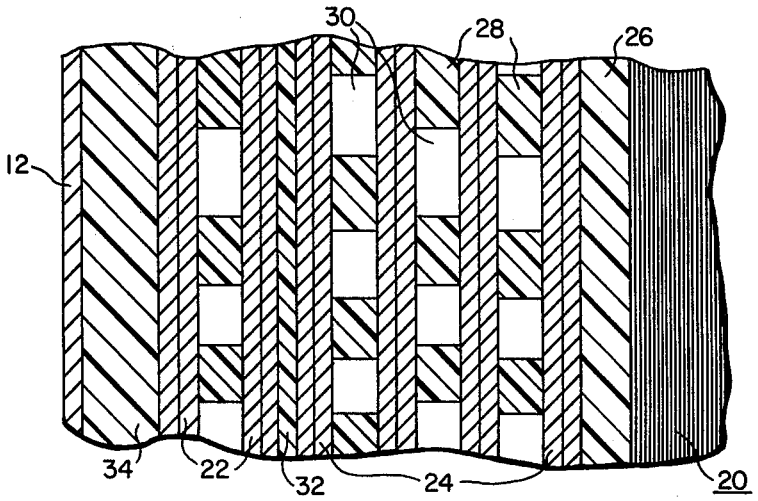

Both the high and low voltage conductors 22 and 24 are concentrically wound around the leg of the core 20 in layers two conductors deep. As shown in FIG. 2, a plurality of vertically extending spacers 28 hold each layer of the high and low voltage conductors 22 and 24 in spaced relation from adjacent layers whereby a plurality of vertically extending cooling ducts 30 are formed. According to the preferred embodiment of this invention, the spacers 28 are constructed of a cellulose material such as pressboard or kraftboard. In addition, the innermost layer of the low voltage conductor 24 is wrapped around a winding tube 26 which insulates the conductor 24 from the grounded core 20. The high and low voltage conductors, 22 and 24, are further insulated from each other by an insulative material 32, typically kraft paper, which is applied at the interface of the high and low voltage conductors 22 and 24 in the preferred embodiment.

The case 12, according to the preferred embodiment, is form fit to the shape of the transformer 14, such that about one-quarter inch separates the walls of the case 12 from the core and core assembly 16. The case 12 also supports bushings 38 and 40 which, are normally connected by electric leads, not shown, to the high and low voltage conductors 22 and 24 whereby the conductors 22 and 24 are coupled to an external electric potential.

The space between the walls of the case 12 and the core and coil assembly 16 is filled with an inert filler material 34, such as pressboard or cellular foam to minimize the amount of liquid dielectric 42 necessary to completely fill the case 12. In addition, the filler material 34 covers the top and bottom of the core and coil assembly 16, as shown in FIG. 1, with only the cooling ducts 30 extending therethrough. A sump 56 is formed below the core and coil assembly 16 which is in fluid flow communication with the lower end of the cooling ducts 30 and serves to keep the cooling ducts 30 filled with liquid dielectric 42. The filler material 34 covering the top of the core and coil assembly 16 defines a space or cavity 44 in the upper portion of the enclosure 12 wherein bushings 38 and 40 and the electric leads are disposed. This space 44 is in fluid flow communication with the upper end of the cooling ducts 30.

According to the preferred embodiment, a vaporizable dielectric 42 is used in sufficient quantity to completely immerse the electric members, when the transformer 14 is deenergized and at ambient temperature and pressure, for the joint purpose of cooling the heat producing winding 18 and also to provide electrical insulation between the electric leads, bushings 38 and 40 and turns of the winding 18. Accordingly, under no load conditions, the liquid dielectric 42 fills the cooling ducts 30, the upper space 44 and the sump 56.

As an alternative to the cooling of electrical inductive apparatus by circulating oil throughout the case 12, it is known to those skilled in the art to use a liquid dielectric which is vaporizable within the normal operating temperature range of the transformer 14. This type of liquid dielectric removes a quantity of heat from the transformer 14 equal to the latent heat of vaporization of the liquid. As mentioned above, the liquid dielectric 42 must also provide sufficient electrical insulation between the turns of the high and low voltage conductors 22 and 24 of the winding 18 and also between the bushings 38 and 40 and the electric leads. Although a typical liquid dielectric 42 provides sufficient insulation in its liquid state, it must also have adequate insulative properties in its vapor state since a large portion of the case 12 will be filled with such vapors at the normal operating temperature of the transformer 14. As known to those skilled in the art, liquid dielectrics with such properties generally include the inert fluorinated organic compounds, such as perflurodibutyl ether or perflurocyclic ether. Other examples of compounds that may be used to practice this invention are listed in greater detail in U.S. Pat. No. 2,961,476, in the name of Maslin and Narbut.

In order to adequately cool the transformer 14, the evolved vapors must be condensed and returned to the case 12 to resupply the quantity of liquid dielectric 42 contained therein. Accordingly, a cooler or radiator 46 is provided, as shown in FIG. 1. The radiator 46 has a first or inlet opening 48 disposed in fluid flow communication with the case 12, preferably located near the top of the case 12. A second connecting means 50, such as a conduit, having first and second openings 52 and 54 respectively, is disposed in fluid flow communication between the radiator 46 and the sump 56 at the bottom of the case 12.

As the temperature of the winding 18 increases with the applied load, a portion of the liquid dielectric 42 contained in the cooling ducts 30 will vaporize. The vapor bubbles, having a lower density than the liquid dielectric 42 contained in the cooling ducts 30, will rise vertically to the space 44 at the top of the case 12. Convection will cause a flow of liquid dielectric 42 from the sump 56 into the cooling ducts 30 and thereby maintain a constant level of dielectric strength between each turn of the winding 18. As the temperature and vapor volume within the case 12 increase, so will the pressure. This pressure will force the vapors through inlet opening 48 since the pressure in the radiator 46 is lower than that in the case 12. The vapors will subsequently condense on the walls of the radiator 46 and flow by gravity to the bottom of the radiator 46 whereupon they will enter conduit 50 through opening 52 and thereby flow into the sump 56 through outlet opening 54 of conduit 50.

It should be noted that by positioning the radiator 46 above the level of liquid dielectric 42 contained in the case 12, gravity will cause the recondensed liquid 42 to flow through the conduit 50 into the case 12 thereby eliminating the need for a pump to recirculate the recondensed liquid dielectric 42.

As heretofore stated, the vapors of the liquid dielectric 42 provide sufficient electrical insulation for the electric leads, the bushings 38 and 40 and the winding 18 at the normal operating temperature and pressure of the transformer 14, since the dielectric strength of the vapor increases proportionally with the pressure. However, upon initial energization of the transformer 14 and also during periods of light load, the temperature of the winding 18 is insufficient to produce the vapor pressure required for sufficient dielectric strength within the case 12. Thus, in order to provide adequate electric insulation for the leads and the bushings 38 and 40 under such conditions, the liquid dielectric 42 is used in a quantity sufficient to completely immerse the bushings 38 and 40 and the leads. This provides excellent insulation for initial startup since the liquid phase of the fluid 42 has better dielectric properties than its vapor phase.

However, the presence of liquid 42 above the core and coil assembly interferes with the efficient flow of vapor to the radiator 46 and also creates excessive pressures within the case 12 as the transformer approaches its normal operating range. Thus, it becomes necessary to remove a portion of the liquid dielectric 42 in response to a rise in pressure within the case 12. Accordingly, a storage means 58, such as a reservoir, is provided as shown in FIG. 1. A first connecting means 60, such as a conduit, is utilized to provide a fluid flow path between the case 12 and the reservoir 58 wherein a first opening or inlet 62 is disposed in fluid flow communication with the case 12 and a second or outlet opening 64 is disposed in fluid flow communication with the reservoir 58. The reservoir 58 has sufficient capacity to store the quantity of liquid dielectric 42 originally contained in the space 44 or approximately the quantity of liquid 42 originally contained above the liquid level 66, as shown in FIG. 1.

In order to maintain a constant level of dielectric strength between the bushings 38 and 40 and the electric leads, the portion of the dielectric fluid 42 contained above liquid level 66 must be transferred both to and from the reservoir 58 by means responsive to changes in a predetermined parameter within the case 12 caused by the varying load applied to the transformer 14. This parameter can be either pressure, temperature or a combination of the two since these parameters vary directly with the applied load. However, pressure will be used in the preferred embodiment of this invention since it enables a system to be designed that transfers the dielectric fluid 42 with superior reliability since it contains no moving parts.

Accordingly, the reservoir 58 is positioned some distance above the first opening 62 of conduit 60. Optimally, the reservoir 58 is placed above the highest level of dielectric fluid 42 contained in the case 12 to minimize the amount of liquid dielectric 42 remaining in the reservoir 58 and conduit 60 when the transformer 14 is deenergized, and also to enable gravity to force the liquid 42 from the reservoir 58 back into the case 12 when the load on the transformer is removed thereby eliminating the need for a pump. Furthermore, the first opening 62 of conduit 60 is connected to the case 12 below the liquid level 66 so as to be constantly submerged in the liquid dielectric 42 in the case 12.

In operation, a load on the transformer 14 will cause an increase in temperature and pressure within the case 12 which will create a pressure differential between the case 12 and the reservoir 58 since the reservoir 58 is under a vacuum or low pressure according to the preferred embodiment. This pressure difference will cause the liquid 42 to flow into the reservoir 58 through the inlet opening 62 of conduit 60 which is located below the liquid level 66 in the case 12 until the pressure exerted by the height of liquid contained in the reservoir 58 is equal to the pressure within the case 12. This method, which is similar to the operation of a manometer, creates a fluid flow without the need for a pump. The removal of liquid dielectric 42 from the case 12 will continue until the liquid dielectric 42 remaining in the case 12 is at a level 66 above the transformer 14, thereby allowing efficient vapor flow to the radiator 46. In addition, the vapor above the liquid level 66 in the case 12 will be under sufficient pressure to provide adequate electrical insulation for the electric leads and the bushings 38 and 40. As the load is removed from the transformer 14, the temperature and pressure within the case 12 will correspondingly fall until at some point, the pressure exerted by the height of liquid dielectric 42 contained in the reservoir 58, or so-called head, will be greater than the pressure in the case 12. This will cause a flow of liquid 42 from the reservoir 58 back into the case 12 until, at the conditions of no load and atmospheric temperature and pressure, the case 12 will again be completely filled with liquid dielectric 42.

Although other means may be utilized to remove and return the excess liquid dielectric 42 from the case 12, including the use of valves, pumps, or sensor devices, the method shown in the preferred embodiment of this invention has the advantage of improved reliability due to the use of components without moving parts.

The novel method of completely filling the case 12 with only one vaporizable liquid dielectric affords many advantages over methods known in the prior art. It is clear that completely filling the case 12 with liquid dielectric 42 provides adequate electrical insulation for the winding 18, electric leads and the bushings 38 and 40 upon initial energization of the transformer 14 or during operation under light loads. Furthermore, by using a form fit tank and filling a major portion thereof with fibrous material, a minimum usage of vaporizable liquid dielectric 42 is attained. For example, 330 gallons of oil are normally used to cool a 1,000 KVA transformer. By using a vaporizable liquid, which dissipates more heat than oil, along with the aforementioned tank design, only 50 gallons of vaporizable liquid dielectric are needed to fill the case and provide adequate cooling and insulation for the 1,000 KVA transformer.

In addition, the use of only one type of fluid eliminates the deleterious effects caused by the use of a non-condensable gas or second vaporizable liquid for cold start insulation. The presence of even a small amount of such a second fluid drastically reduces the cooling efficiency of prior art vaporizable cooling systems since such fluids are ineffective as heat transfer mediums. The use of only one dielectric fluid clearly eliminates any such inefficiencies thereby enabling a smaller cooling system to be used that will dissipate the same quantity of heat as would a larger, prior art type, vaporizable cooling system. Furthermore, the complex separation equipment needed to separate the non-condensable gas or second vaporizable liquid from the primary vaporizable liquid is thereby eliminated. This not only improves cooling efficiency since it is impossible to completely separate the aforementioned fluids from the primary vaporizable liquid in prior art cooling systems; but furthermore, this novel method has greater reliability since it contains no valves or pumps which normally attend the use of such separation equipment.

Thus, it will be apparent to one skilled in the art, that there has been disclosed a novel vaporizable liquid cooling system for electrical inductive apparatus wherein only one vaporizable fluid is used to fill the case and thereby provide adequate electric insulation for the initial energization of the apparatus. Such a cooling system is extremely efficient since no other fluid which would interfere with the flow of the vaporized liquid is needed. By removing a portion of the liquid dielectric in response to a pressure rise within the case, cooling efficiency is maximized along with an improvement in reliability since the liquid is removed and returned to the case by pressure differences, thereby eliminating the use of pumps or valves containing moving parts which adversely affect reliability of the electrical inductive apparatus.

What is claimed:

1. An electrical inductive apparatus, comprising:

a case having electrical bushings, said electrical bushings including encased terminals and external terminals;

an electrical winding, subject to temperature changes while energized, disposed in inductive relation with a magnetic core ddisposed in said case;

alectric leads disposed in said case and operative to connect said electrical winding to the encased terminals of said selectrical bushings;

a liquid dielectric vaporizable within the normal operating temperature range of said electrical winding disposed in said case whereby cooling of said electrical winding is effected by the vaporization of said liquid dielectric; said liquid dielectric completely immersing said electrical winding, said encased terminals and said electric leads when said electrical winding is de-energized and substantially all of said liquid dielectric is in the liquid phase to provide electrical insulation for said electrical winding, said encased terminals and said electric leads;

storage means disposed in fluid flow communication with said case; and transfer means responsive to a predetermined parameter in said case, associated with the vaporization of said liqid dielectric for transferring a portion of said liquid dielectric from said case to said storage means, said electric leads and encased terminals being alternately immersed in said liquid dielectric and exposed in response to changes in the predetermined parameter, while said electrical winding is constantly immersed in said liquid dielectric, with vapor in the space formed around said encased terminals and electric leads when said liquid dielectric is transferred to the storage means, maintaining a constant level of dielectric strength for said enclosed terminals and electric leads as the liquid is removed, without having a non-condensable gas.

2. The electrical inductive apparatus of claim 1, wherein the transfer means are responsive to the pressure within the case.

3. The electrical inductive apparatus of claim 1, wherein the transfer means contain no moving parts.

4. The electrical inductive apparatus of claim 2, wherein the transfer means provide a pressure differential between said case and said storage means which transfers a portion of said liquid dielectric between said case and said storage means in the direction of lowest pressure.

5. The electrical inductive apparatus of claim 4, wherein the storage means and the transfer means comprise a reservoir and a connecting means; said connecting means having first and second openings disposed in fluid flow communication between the case and said reservoir, respectively; said first opening of said connecting means being connected to said case below the level of the liquid dielectric disposed in said case whereby said first opening is constantly submerged in said liquid dielectric; said reservoir having a substantially low pressure when devoid of said liquid dielectric; said reservoir further being spaced a predetermined distance above said first opening of said connecting means whereby a pressure is provided by the height of said liquid dielectric contained in said reservoir in pressure differential fluid flow relationship with said case.

6. The electrical inductive apparatus of claim 1, wherein a sump is disposed below the electrical winding and an upper space is disposed above said electrical winding in said case; said electrical winding forming a plurality of terms around the magnetic core; a plurality of spacer members disposed between said turns of said electrical winding to form a plurality of vertically extending cooling ducts between adjacent spacer members which are disposed in fluid flow communication between said sump and said upper space in said case; and cooling means disposed in fluid flow communication between said upper space and said sump to condense the evolved vapors of the liquid dielectric.

* * * * *